US009249747B2

(12) United States Patent
Matthews

(10) Patent No.: US 9,249,747 B2
(45) Date of Patent: Feb. 2, 2016

(54) AIR MASS DETERMINATION FOR CYLINDER ACTIVATION AND DEACTIVATION CONTROL SYSTEMS

(71) Applicant: GM Global Technology Operations LLC, Detroit, MI (US)

(72) Inventor: Gregory P. Matthews, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 268 days.

(21) Appl. No.: 13/798,435

(22) Filed: Mar. 13, 2013

(65) Prior Publication Data

US 2014/0069374 A1 Mar. 13, 2014

Related U.S. Application Data

(60) Provisional application No. 61/698,996, filed on Sep. 10, 2012.

(51) Int. Cl.
*F02D 41/00* (2006.01)
*F02D 41/18* (2006.01)
(Continued)

(52) U.S. Cl.
CPC ..... *F02D 41/0087* (2013.01); *F02D 41/18* (2013.01); *F02D 37/02* (2013.01);
(Continued)

(58) Field of Classification Search
CPC ..... F02D 41/0087; F02D 41/008; F02D 41/0082; F02D 41/0085; F02D 17/02; F02D 17/023; F02D 41/18; F02D 41/0062; F02D 37/02; F02D 2041/0012; F02D 2041/1412; F02D 2200/0402; F02D 2250/18
USPC ..... 123/481, 198 F, 325, 332, 350; 701/101–104, 112
See application file for complete search history.

(56) References Cited

U.S. PATENT DOCUMENTS 4,377,997 A 3/1983 Staerzl
4,509,488 A 4/1985 Forster et al.
(Continued)

FOREIGN PATENT DOCUMENTS

CN 101353992 A 1/2009
CN 102454493 A 5/2012

OTHER PUBLICATIONS

U.S. Appl. No. 14/211,389, filed Mar. 14, 2014, Liu et al.
(Continued)

*Primary Examiner* — Stephen K Cronin
*Assistant Examiner* — Xiao Mo

(57) ABSTRACT

A system includes a cylinder event module that determines an air-per-cylinder value for a cylinder intake event or a cylinder non-intake event of a current cylinder based on a mass air flow signal and an engine speed signal. A status module generates a status signal indicating whether the current cylinder is activated. A deactivation module, based on the status signal, determines a current accumulated air mass in an intake manifold of an engine: for air received by the intake manifold since a last cylinder intake event of an activated cylinder and prior to one or more consecutive cylinder non-intake events of one or more deactivated cylinders; and based on a previous accumulated air mass in the intake manifold and the air-per-cylinder value. An activation module, based on the status signal, determines an air mass value for the current cylinder based on the air-per-cylinder value and the current accumulated air mass.

20 Claims, 4 Drawing Sheets

(51) Int. Cl.
*F02D 37/02* (2006.01)
*F02D 41/14* (2006.01)

(52) U.S. Cl.
CPC ..... *F02D41/0062* (2013.01); *F02D 2041/0012* (2013.01); *F02D 2041/1412* (2013.01); *F02D 2200/0402* (2013.01); *F02D 2250/18* (2013.01)

(56) References Cited

U.S. PATENT DOCUMENTS 4,535,744 A 8/1985 Matsumura
5,042,444 A 8/1991 Hayes et al.
5,094,213 A 3/1992 Dudek et al.
5,226,513 A 7/1993 Shibayama
5,357,932 A 10/1994 Clinton et al.
5,374,224 A 12/1994 Huffmaster et al.
5,377,631 A 1/1995 Schechter
5,423,208 A 6/1995 Dudek et al.
5,465,617 A 11/1995 Dudek et al.
5,669,354 A 9/1997 Morris
5,884,605 A 3/1999 Nagaishi et al.
5,909,720 A 6/1999 Yamaoka et al.
6,360,724 B1 3/2002 Suhre et al.
6,760,656 B2 * 7/2004 Matthews et al. ..... 701/101
6,978,204 B2 12/2005 Surnilla et al.
7,066,121 B2 6/2006 Michelini et al.
7,069,718 B2 7/2006 Surnilla et al.
7,100,720 B2 9/2006 Ishikawa
7,140,355 B2 11/2006 Michelini et al.
7,174,879 B1 2/2007 Chol et al.
7,292,231 B2 11/2007 Kodama et al.
7,292,931 B2 11/2007 Davis et al.
7,319,929 B1 1/2008 Davis et al.
7,363,111 B2 4/2008 Vian et al.
7,464,676 B2 12/2008 Wiggins et al.
7,497,074 B2 3/2009 Surnilla et al.
7,499,791 B2 3/2009 You et al.
7,577,511 B1 8/2009 Tripathi et al.
7,685,976 B2 3/2010 Marriott
7,785,230 B2 8/2010 Gibson et al.
7,849,835 B2 12/2010 Tripathi et al.
7,886,715 B2 2/2011 Tripathi et al.
7,930,087 B2 4/2011 Gibson et al.
7,954,474 B2 6/2011 Tripathi et al.
8,099,224 B2 1/2012 Tripathi et al.
8,131,445 B2 3/2012 Tripathi et al.
8,131,447 B2 3/2012 Tripathi et al.
8,146,565 B2 4/2012 Leone et al.
8,272,367 B2 9/2012 Shikama et al.
8,616,181 B2 12/2013 Sahandiesfanjani et al.
8,646,430 B2 2/2014 Kinoshita
8,646,435 B2 2/2014 Dibble et al.
8,701,628 B2 4/2014 Tripathi et al.
8,833,058 B2 9/2014 Ervin et al.
8,833,345 B2 9/2014 Pochner et al.
2003/0131820 A1 7/2003 Mckay et al.
2003/0172900 A1 9/2003 Boyer et al.
2005/0016492 A1 1/2005 Matthews
2005/0131618 A1 6/2005 Megli et al.
2005/0197761 A1 9/2005 Bidner et al.
2005/0204726 A1 9/2005 Lewis
2005/0204727 A1 9/2005 Lewis et al.
2005/0205028 A1 9/2005 Lewis et al.
2005/0205045 A1 9/2005 Michelini et al.
2005/0205060 A1 9/2005 Michelini et al.
2005/0205063 A1 9/2005 Kolmanovsky et al.
2005/0205069 A1 9/2005 Lewis et al.
2005/0205074 A1 9/2005 Gibson et al.
2005/0235743 A1 10/2005 Stempnik et al.
2006/0107919 A1 5/2006 Nishi et al.
2007/0042861 A1 2/2007 Takaoka et al.
2007/0107692 A1 5/2007 Kuo et al.
2007/0131196 A1 6/2007 Gibson et al.
2007/0235005 A1 10/2007 Lewis
2008/0066699 A1 3/2008 Michelini et al.
2008/0154468 A1 6/2008 Berger et al.
2008/0288146 A1 11/2008 Beechie et al.
2009/0030594 A1 1/2009 You et al.
2009/0042458 A1 2/2009 Kinoshita
2009/0177371 A1 7/2009 Reinke
2009/0248277 A1 10/2009 Shinagawa et al.
2009/0248278 A1 10/2009 Nakasaka
2010/0006065 A1 1/2010 Tripathi et al.
2010/0010724 A1 1/2010 Tripathi et al.
2010/0059004 A1 3/2010 Gill
2010/0100299 A1 4/2010 Tripathi et al.
2010/0192925 A1 8/2010 Sadakane
2010/0211299 A1 8/2010 Lewis et al.
2011/0030657 A1 2/2011 Tripathi et al.
2011/0048372 A1 3/2011 Dibble et al.
2011/0144883 A1 6/2011 Rollinger et al.
2011/0208405 A1 8/2011 Tripathi et al.
2011/0213540 A1 9/2011 Tripathi et al.
2011/0213541 A1 9/2011 Tripathi et al.
2011/0251773 A1 10/2011 Sahandiesfanjani et al.
2012/0055444 A1 3/2012 Tobergte et al.
2012/0109495 A1 5/2012 Tripathi et al.
2012/0116647 A1 5/2012 Pochner et al.
2012/0143471 A1 6/2012 Tripathi et al.
2012/0221217 A1 8/2012 Sujan et al.
2012/0285161 A1 11/2012 Kerns et al.
2013/0092128 A1 4/2013 Pirjaberi et al.
2014/0090624 A1 4/2014 Verner

OTHER PUBLICATIONS

U.S. Appl. No. 14/300,469, filed Jun. 10, 2014, Li et al.
U.S. Appl. No. 14/310,063, filed Jun. 20, 2014, Wagh et al.
U.S. Appl. No. 14/449,726, filed Aug. 1, 2014, Hayman et al.
U.S. Appl. No. 14/548,501, filed Nov. 20, 2014, Beikmann et al.
U.S. Appl. No. 61,952,737, filed Mar. 13, 2014, Shost et al.
U.S. Appl. No. 13/798,351, filed Mar. 13, 2013, Rayl.
U.S. Appl. No. 13/798,384, filed Mar. 13, 2013, Burtch.
U.S. Appl. No. 13/798,400, filed Mar. 13, 2013, Phillips.
U.S. Appl. No. 13/798,451, filed Mar. 13, 2013, Rayl.
U.S. Appl. No. 13/798,471, filed Mar. 13, 2013, Matthews et al.
U.S. Appl. No. 13/798,518, filed Mar. 13, 2013, Beikmann.
U.S. Appl. No. 13/798,536, filed Mar. 13, 2013, Matthews et al.
U.S. Appl. No. 13/798,540, filed Mar. 13, 2013, Brennan et al.
U.S. Appl. No. 13/798,574, filed Mar. 13, 2013, Verner.
U.S. Appl. No. 13/798,586, filed Mar. 13, 2013, Rayl et al.
U.S. Appl. No. 13/798,590, filed Mar. 13, 2013, Brennan et al.
U.S. Appl. No. 13/798,624, filed Mar. 13, 2013, Brennan et al.
U.S. Appl. No. 13/798,701, filed Mar. 13, 2013, Burleigh et al.
U.S. Appl. No. 13/798,737, filed Mar. 13, 2013, Beikmann.
U.S. Appl. No. 13/798,775, filed Mar. 13, 2013, Phillips.
U.S. Appl. No. 13/799,116, filed Mar. 13, 2013, Brennan.
U.S. Appl. No. 13/799,129, filed Mar. 13, 2013, Beikmann.
U.S. Appl. No. 13/799,181, filed Mar. 13, 2013, Beikmann.
U.S. Appl. No. 14/734,619, filed Jun. 9, 2015, Matthews.

* cited by examiner

AIR MASS DETERMINATION FOR CYLINDER ACTIVATION AND DEACTIVATION CONTROL SYSTEMS

CROSS-REFERENCE TO RELATED APPLICATIONS

This application claims the benefit of U.S. Provisional Application No. 61/698,996 filed on Sep. 10, 2012. The disclosure of the above application is incorpoated herein by reference in its entirety.

This application is related to U.S. patent application Ser. No. 13/798,451 filed on Mar. 13, 2013, Ser. No. 13/798,351 filed on Mar. 13, 2013, Ser. No.13/798,586 filed on Mar. 13, 2013, Ser. No. 13/798,590 filed on Mar. 13, 2013, Ser No. 13/798,536 filed on Mar. 13, 2013, Ser No. 13/798,471 filed on Mar. 13, 2013, Ser.No. 13/798,737 filed on Mar. 13, 2013, Ser. No. 13/798,701 filed on Mar. 13, 2013, Ser. No. 13/798,518 filed on Mar. 13, 2013, Ser. No. 13/799,129 filed on Mar. 13, 2013, Ser. No. 13/798,540 filed on Mar. 13, 2013, Ser. No. 13/798,574 filed on Mar. 13, 2013, Ser. No. 13/799,181 filed on Mar. 13, 2013, Ser. No. 13/799,116 filed on Mar. 13, 2013, Ser. No. 13/798,624 filed on Mar. 13, 2013, Ser. No. 13/798,384 filed on Mar. 13, 2013, Ser. No. 13/798,775 filed on Mar. 13, 2013, and Ser. No. 13/798,400 filed on Mar. 13, 2013. The entire disclosures of the above applications are incorporated herein by reference.

FIELD

The present disclosure relates to internal combustion engines and more specifically to cylinder activation and deactivation control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine (ICE) combusts mixtures of air and fuel (air/fuel mixtures) within cylinders to actuate pistons and produce drive torque. Air flow and fuel injection of the ICE may be controlled respectively via a throttle and a fuel injection system. Position adjustment of the throttle adjusts air flow into the ICE. The fuel injection system may be used to adjust a rate that fuel is injected into the cylinders to provide predetermined air/fuel mixtures in the cylinders and/or to achieve a predetermined torque output from the ICE. Increasing the amount of air and/or fuel to the cylinders, increases the torque output of the ICE.

During certain situations, one or more of the cylinders of the ICE may be deactivated, for example, to conserve fuel. Deactivation of a cylinder may include deactivating intake and/or exhaust valves of the cylinder and halting injection of fuel into the cylinder. One or more cylinders may be deactivated, for example, when the remaining cylinders that are activated are capable of producing a requested amount of output torque.

SUMMARY

A system is provided and includes a cylinder event module that determines an air-per-cylinder value for one of a cylinder intake event or a cylinder non-intake event of a current cylinder of an engine based on a mass air flow signal and an engine speed signal. The engine includes cylinders including the current cylinder. A status module generates a status signal indicating whether the current cylinder is activated or deactivated. A deactivation module, based on the status signal, determines a current accumulated air mass in an intake manifold of the engine: for air received by the intake manifold since a last cylinder intake event of an activated cylinder and prior to one or more consecutive cylinder non-intake events of one or more deactivated cylinders; and based on a previous accumulated air mass in the intake manifold and the air-per-cylinder value. An activation module, based on the status signal, determines an air mass value for the current cylinder based on the air-per-cylinder value and the current accumulated air mass.

In other features, a method is provided and includes determining an air-per-cylinder value for one of a cylinder intake event or a cylinder non-intake event of a current cylinder of an engine based on a mass air flow signal and an engine speed signal. The engine includes cylinders including the current cylinder. A status signal is generated indicating whether the current cylinder is activated or deactivated. Based on the status signal, a current accumulated air mass in an intake manifold of the engine is determined: for air received by the intake manifold since a last cylinder intake event of an activated cylinder and prior to consecutive cylinder non-intake events of at least two deactivated cylinders; and based on a previous accumulated air mass in the intake manifold and the air-per-cylinder value. Based on the status signal, an air mass value for the current cylinder is determined based on the air-per-cylinder value and the current accumulated air mass.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
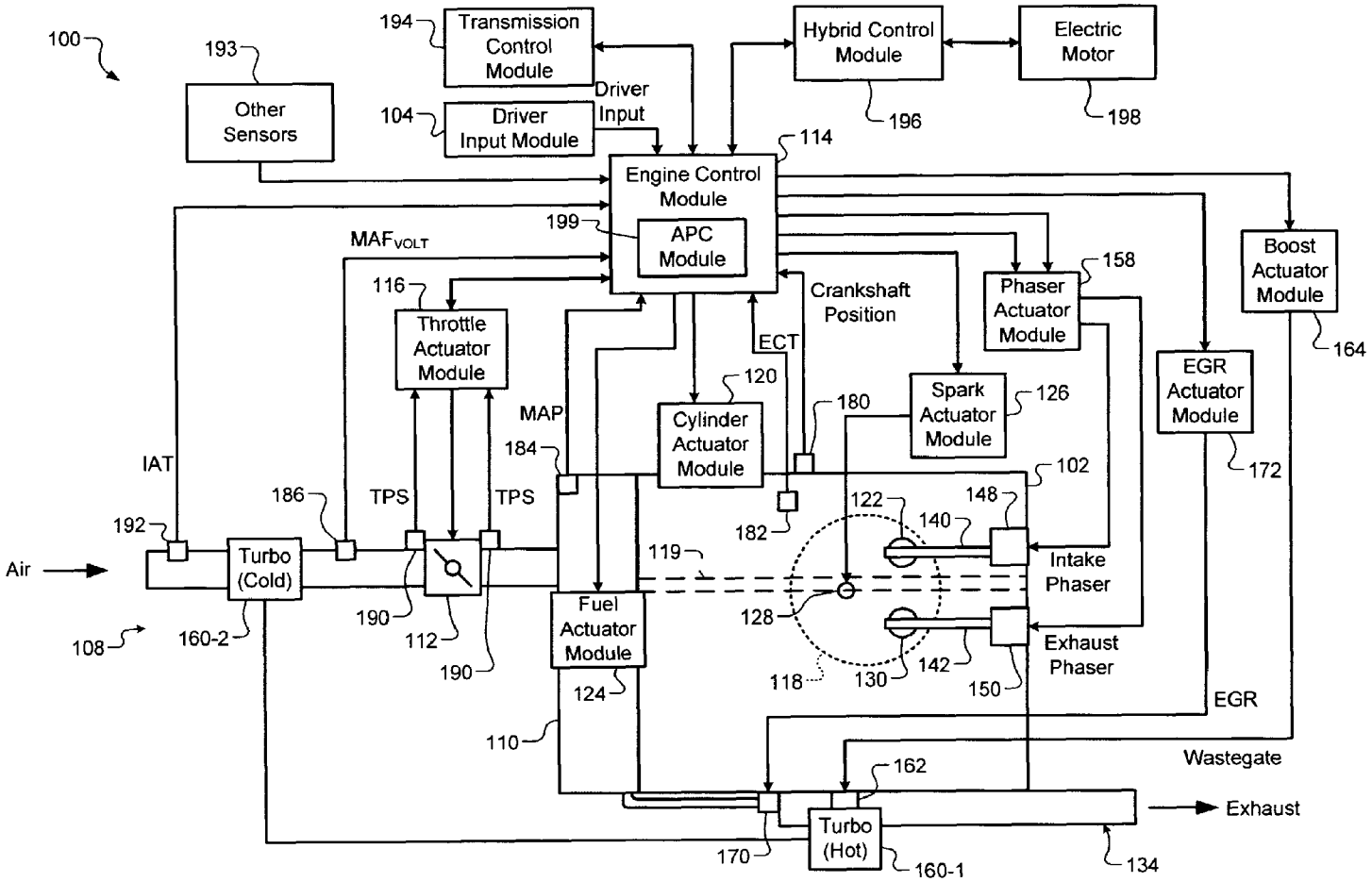
FIG. 1 is a functional block diagram of an engine system incorporating an air per cylinder module in accordance with the present disclosure.

Accuracy of measured air flowing into an intake manifold of an engine and air drawn into cylinders of the engine affects accuracy of estimated and predicted air masses in the cylinders of the engine. An air meter (e.g., mass air flow sensor) may be used to measure air entering an intake manifold of an engine. The air meter may be located upstream from the engine and may be sampled prior to each cylinder intake event. There is a uniform number of cranking degrees between cylinder intake events when all cylinders of an engine are activated. As an example, for an eight cylinder engine with all eight cylinders activated, each cylinder intake event may occur after each 90° rotation of a crankshaft of the engine. An intake valve is opened during a cylinder intake event to draw air into the corresponding cylinder. A crankshaft of an engine may rotate twice (720°) for a single engine cycle. Each engine cycle includes a cylinder intake event for each cylinder of the engine. As another example, for a six cylinder engine with all six cylinders activated each cylinder intake event may occur after each 120° rotation of a crankshaft of the engine. As yet another example, for a four cylinder engine with all four cylinders activated each cylinder intake event may occur after each 180° rotation of a crankshaft of the engine.

For active fuel management (AFM) engines that perform cylinder activation and deactivation, the number of activated cylinders of an engine at a certain moment in time may be less than the total number of cylinders. As a result, there is a non-uniform number of cranking degrees between cylinder intake events. For example, a six cylinder engine operating with four activated cylinders may have a non-uniform pattern of the number of cranking degrees per cylinder intake event (e.g., 120°, 120°, 240°, 120°, 120°, 240°. An engine may deactivate and reactivate any number of cylinders in various patterns and/or at random. The number of cylinders activated and deactivated, an ignition order of the cylinders, and a selected cylinder identified for ignition may be random and/or determined based on, for example, engine load.

One technique in estimating air-per-cylinder (APC) in an engine is to determine a total amount of air (or total air mass) received by an intake manifold of the engine over an engine cycle and divide the total air mass by a number of activated cylinders. The total air mass includes air received during cylinder intake events of activated cylinders and cylinder non-intake events of deactivated cylinders. This technique provides a uniform determination of an air mass per activated cylinder. A cylinder non-intake event refers to a period of a cylinder cycle of a deactivated cylinder at which a corresponding intake valve would normally open if the deactivated cylinder were activated. The intake valve of the deactivated cylinder may be deactivated and/or remain closed while the cylinder is deactivated.

For example, in an eight cylinder engine, an air intake manifold value may be determined for each cylinder intake event of activated cylinders and for each cylinder non-intake event of deactivated cylinders (e.g., every 90° of crankshaft rotation). For each air intake manifold value determined, voltage readings of the air meter may be converted to a frequency signal. The number of pulses of the frequency signal may be counted over a predetermined measuring period prior to the corresponding cylinder intake or non-intake event. The number of pulses provides an average frequency over the duration of the predetermined measuring period. An estimate of air mass received by the intake manifold during the predetermined measuring period for the corresponding cylinder is then determined based on the number of pulses and an engine speed via, for example, a look-up table. This process is repeated for the eight cylinders regardless of whether a cylinder is deactivated and the air mass values are summed to provide a total air mass. The total air mass is then divided by the number of activated cylinders to estimate the air mass drawn into each activated cylinder. The air mass values for each of the deactivated cylinders may be set to zero.

The uniform determination of an air mass per activated cylinder can be accurate when an activation/deactivation sequence of the cylinders of an engine is uniform. As an example, in an eight cylinder engine, a uniform activation/deactivation sequence may include every other cylinder of the engine being deactivated. However, in a full authority (FA) AFM engine system the activation/deactivation sequences may not be uniform and as a result the patterns of cranking degrees per cylinder intake event may not be uniform. A FA AFM engine system refers to an engine system that is capable of operating on any number of cylinders and is capable of selecting which one or more cylinders of the engine are to be activated at any moment in time. FA AFM engine systems can have complex non-uniform patterns of cranking degrees per cylinder intake event.

Estimation and/or prediction of air masses in each cylinder of an engine of a FA AFM engine system can be inaccurate using the uniform determination of an air mass per activated cylinder process described above. For example, cylinder intake events of two or more activated cylinders of a FA AFM engine may sequentially follow cylinder non-intake events of two or more deactivated cylinders. The air mass received by a first one of the activated cylinders (first activated cylinder after the series of two or more deactivated cylinders) is greater than that received by subsequent ones of the activated cylinders. This is due to a buildup of air mass in an intake manifold of the FA AFM engine during cylinder non-intake events of the previous deactivated cylinders. As a result, the air mass received by each of the activated cylinders is not the same and can vary from one activated cylinder to another activated cylinder.

Air mass per cylinder estimation and/or prediction can be used in determining parameters, such as fuel injection amounts, torque values, etc. Inaccurate estimations and/or predictions in the amounts of air mass in each cylinder of an engine, negatively affects determining these parameters and as a result can negatively affect air/fuel ratios in the cylinders of an engine.

The implementations disclosed herein include accurately determining air mass values for air entering an intake manifold of an engine and air mass values for air to be drawn from each intake port of the intake manifold to each respective cylinder of the engine. The air mass values are determined between consecutive cylinder intake events for both activated and deactivated cylinders and while the engine is operating with non-uniform patterns of cranking degrees per cylinder intake event. This improves accuracy of air mass estimations and predictions for each cylinder of the engine, which can result in accurate determinations of parameters dependent on the air mass estimations and predictions. For example, accuracy of fuel injection determinations and torque values can be improved resulting in improved air/fuel mixtures. As a result of improved air/fuel mixtures, fuel efficiency may be improved, engine emissions may be decreased, and a required amount of precious metal to be included in a catalytic converter during manufacturing of the catalytic converter may be decreased. Examples of precious metals are platinum, rhodium, copper, cerium, iron, manganese and nickel.

In FIG. 1, an engine system 100 is shown. The engine system 100 of a vehicle includes a FA AFM engine 102 (hereinafter the engine 102) that combusts an air/fuel mixture to produce torque based on driver input from a driver input module 104. Air is drawn into the engine 102 through an intake system 108. The intake system 108 may include an intake manifold 110 and a throttle valve 112. An engine control module (ECM) 114 controls a throttle actuator module 116 to regulate opening of the throttle valve 112 and to control airflow into the intake manifold 110.

Air from the intake manifold 110 is drawn into cylinders of the engine 102. While the engine 102 may include any number of cylinders, a single representative cylinder 118 is shown for illustration purposes. The ECM 114 may instruct a cylinder actuator module 120 to selectively deactivate one or more of the cylinders.

The engine 102 may operate using a four-stroke cylinder cycle. The four strokes include an intake stroke, a compression stroke, a combustion stroke, and an exhaust stroke. During each revolution of a crankshaft 119, each of the cylinders experiences two of the four strokes. Therefore, two crankshaft revolutions are necessary for each of the cylinders to experience all four of the strokes.

During the intake stroke, air from the intake manifold 110 is drawn into the cylinder 118 from an intake port of the intake manifold 110 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which is referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may halt provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time at which the piston returns to a bottom most position, which is referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The cylinder actuator module 120 may deactivate the cylinder 118 by deactivating opening of the intake valve 122 and/or the exhaust valve 130. The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158. In various other implementations, the intake valve 122 and/or the exhaust valve 130 may be controlled by actuators other than camshafts, such as electromechanical actuators, electrohydraulic actuators, electromagnetic actuators, etc.

The engine system 100 may include a boost device that provides pressurized air to the intake manifold 110. For example, FIG. 1 shows a turbocharger including a turbine 160-1 that is driven by exhaust gases flowing through the exhaust system 134. The turbocharger also includes a compressor 160-2 that is driven by the turbine 160-1 and that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. Although shown separated for purposes of illustration, the turbine 160-1 and the compressor 160-2 may be mechanically linked to each other, placing intake air in close proximity to hot exhaust. The compressed air charge may absorb heat from components of the exhaust system 134.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

Crankshaft position may be measured using a crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192. The engine system 100 may also include one or more other sensors 193. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The engine 102 outputs torque to the transmission via the crankshaft 119.

The ECM 114 may communicate with a hybrid control module 196 to coordinate operation of the engine 102 and one or more electric motors 198. The electric motor 198 may also function as a generator, and may be used to produce electrical energy for use by vehicle electrical systems and/or for storage in a battery.

Each system that varies an engine parameter may be referred to as an engine actuator. Each engine actuator receives an actuator value. For example, the throttle actuator module 116 may be referred to as an engine actuator, and the throttle opening area may be referred to as the actuator value. In the example of FIG. 1, the throttle actuator module 116 achieves the throttle opening area by adjusting an angle of the blade of the throttle valve 112.

The spark actuator module 126 may also be referred to as an engine actuator, while the corresponding actuator value may be the amount of spark advance relative to cylinder TDC. Other engine actuators may include the cylinder actuator module 120, the fuel actuator module 124, the phaser actuator module 158, the boost actuator module 164, and the EGR actuator module 172. For these engine actuators, the actuator values may correspond to a cylinder activation/deactivation sequence, fueling rate, intake and exhaust cam phaser angles, boost pressure, and EGR valve opening area, respectively. The ECM 114 may generate the actuator values in order to cause the engine 102 to generate a desired engine output torque.

The ECM 114 and/or one or more other modules of the engine system 100 may implement a cylinder activation/deactivation system of the present disclosure. For example, the ECM 114 selects a next cylinder deactivation pattern based on one or more factors, including, but not limited to, engine speed, requested torque, a selected gear, air-per-cylinder (APC, e.g., an estimate or calculation of the mass of air in each cylinder), residual exhaust per cylinder (RPC, e.g., a mass of residual exhaust gas in each cylinder), and respective cylinder identifications (IDs).

The ECM 114 may include an APC module 199. The APC module 199 determines air mass values of air received by the intake manifold 110 and estimates and predicts air mass values of air to be received by each of the cylinders of the engine 102. An example of the ECM 114 and the APC module 199 are shown in FIGS. 2-3.

Figure 2:
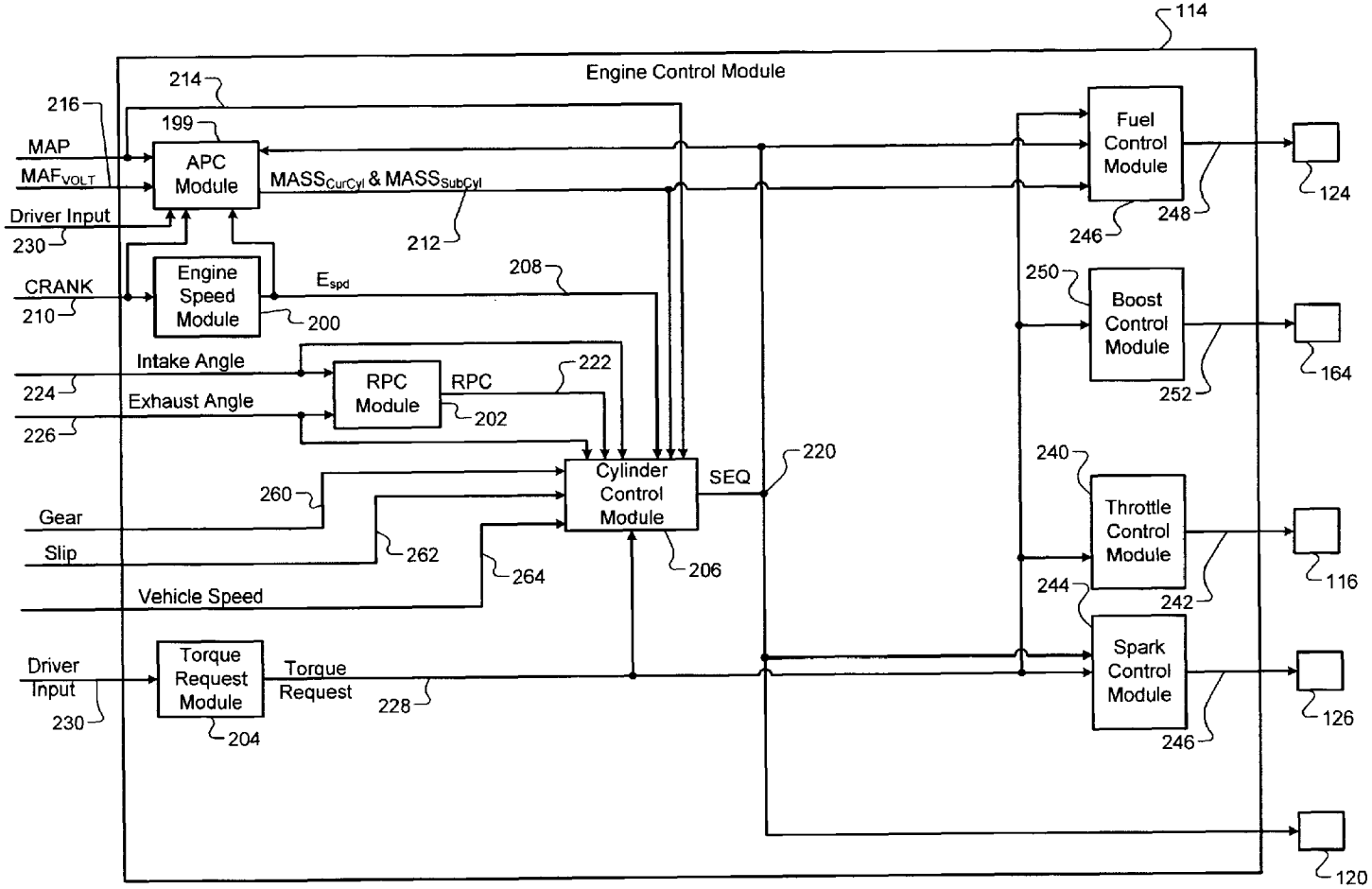
FIG. 2 is a functional block diagram of an example engine control module incorporating the air per cylinder module in accordance with the present disclosure.
Figure 3:
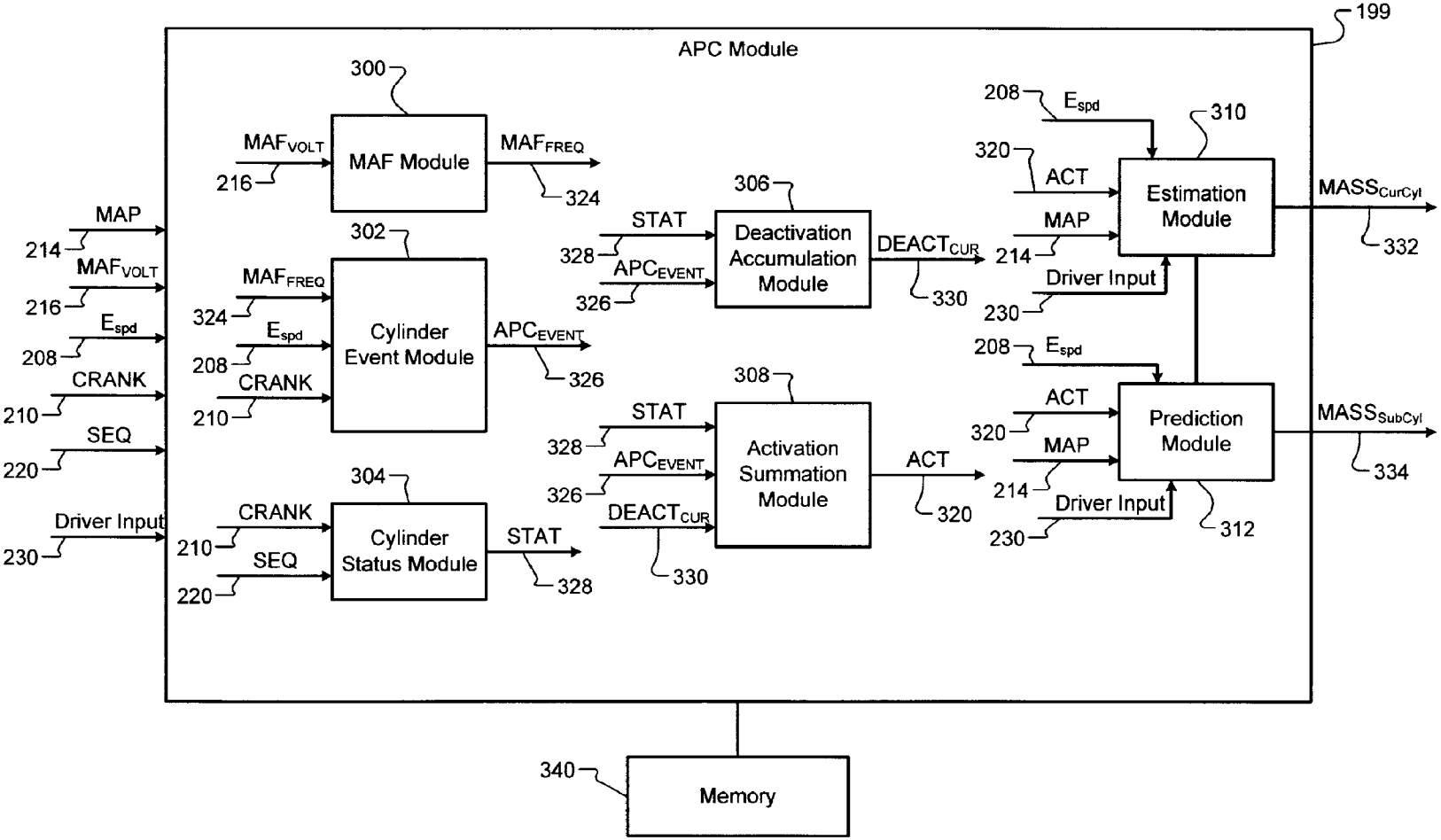
FIG. 3 is a functional block diagram of the air-per-cylinder module of FIGS. 1 and 2.

Referring now also to FIG. 2, a functional block diagram of the ECM 114 is shown. The ECM 114 includes an engine speed module 200, the APC module 199, a residual module 202, a torque request module 204, and a cylinder control module 206. The engine speed module 200 determines a speed $E_{spd}$ 208 of the engine 102 based on a crankshaft position signal CRANK 210 received from the crankshaft position sensor 180.

The APC module 199 estimates an air mass for a current cylinder $MASS_{CurCyl}$ and predicts an air mass for a subsequent cylinder $MASS_{SubCyl}$ (collectively signal 212) based on signals $E_{spd}$ 208, CRANK 210, MAP 214, and $MAF_{VOLT}$ 216 received from the engine speed module 200, the crank position sensor 180, the MAP sensor 184, and the MAF sensor 186. The current cylinder $MASS_{CurCyl}$ and the air mass for a subsequent cylinder $MASS_{SubCyl}$ may also be determined based on an activation/deactivation sequence SEQ 220, as determined by the cylinder control module 206.

The RPC module 202 determines RPC values 222. Although the RPC module 202 is shown as receiving intake and exhaust angle signals 224, 226, the RPC module 202 may determine the RPC values 222 based on the intake and exhaust angle signals 224, 226, an EGR valve position, a MAP, and/or an engine speed.

The torque request module 204 may determine a torque request 228 based on one or more driver inputs 230, such as an accelerator pedal position, a brake pedal position, a cruise control input, and/or one or more other suitable driver inputs. The torque request module 204 may determine the torque request 228 based on one or more other torque requests, such as torque requests generated by the ECM 114 and/or torque requests received from other modules, such as the transmission control module 194, the hybrid control module 196, a chassis control module, etc.

One or more engine actuators may be controlled based on the torque request 228 and/or one or more other torque requests. For example, a throttle control module 240 may determine a throttle opening signal 242 based on the torque request 228. The throttle actuator module 116 may adjust opening of the throttle valve 112 based on the throttle opening signal 242. A spark control module 244 may generate a spark timing signal 246 based on the activation/deactivation sequence SEQ 220 and the torque request 228. The spark actuator module 126 may generate spark based on the spark timing signal 246.

A fuel control module 246 may determine one or more fueling parameters 248 based on the signal 212, the torque request 228, and the activation/deactivation sequence SEQ 220. For example, the fueling parameters 248 may include a fuel injection amount, number of fuel injections for injecting the fuel injecting amount per cylinder cycle, and timing for each of the injections. The fuel actuator module 124 may inject fuel based on the fueling parameters 248. A boost control module 250 may determine a boost level 252 based on the driver torque request 228. The boost actuator module 164 may control boost output by the boost device(s) based on the boost level 252.

The cylinder control module 206 selects the activation/deactivation sequence SEQ 220 based on the torque request 228. The cylinder actuator module 120 activates and deactivates the intake and exhaust valves of the cylinders according to the selected activation/deactivation sequence SEQ 220. The cylinder control module 206 may select the activation/deactivation sequence SEQ 220 based on, for example, the signals 208, 212, 214, 222, 224, 226, 228 and a selected transmission gear, slip and/or vehicle speed. Gear, slip and vehicle speed signals 260, 262, 264 are shown.

Fueling is halted (zero fueling) to cylinders that are to be deactivated according to the activation/deactivation sequence SEQ 220. Fuel is provided to the cylinders that are to be activated according to the activation/deactivation sequence SEQ 220. Spark is provided to the cylinders that are to be activated according to the activation/deactivation sequence SEQ 220. Spark may be provided or halted to cylinders that are to be deactivated according to the activation/deactivation sequence SEQ 220. Cylinder deactivation is different than fuel cutoff (e.g., deceleration fuel cutoff) in that the intake and exhaust valves of cylinders to which fueling is halted are still opened and closed during the fuel cutoff, whereas for cylinder deactivation the intake valves and/or exhaust valves are deactivated (or maintained in a closed state).

In FIG. 3, the APC module 199 includes a MAF module 300, a cylinder event module 302, a cylinder status module 304, a deactivation accumulation module 306, an activation summation module 308, an estimation module 310, and a prediction module 312. The modules 300-312 are now described with respect to the method of FIG. 4.

Figure 4:
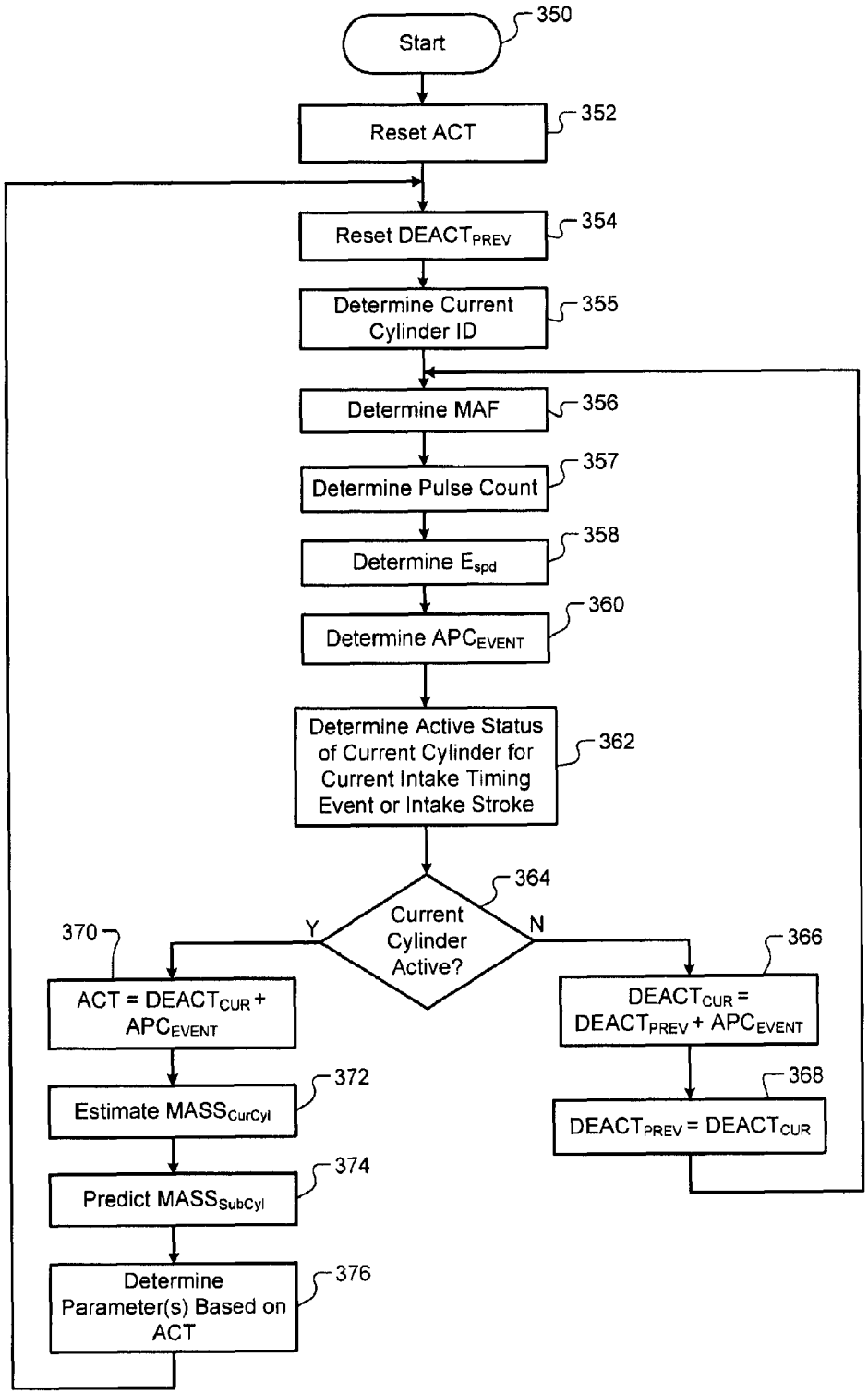
FIG. 4 illustrates a method of operating the engine system of FIG. 1 and the air-per-cylinder module of FIGS. 1-3 in accordance with the present disclosure.

The engine system 100 and the APC module 199 may be operated using numerous methods, an example method is provided in FIG. 4. In FIG. 4, a method of operating the engine system 100 and the APC module 199 is shown. The method may include one or more algorithms. Although the following tasks are primarily described with respect to the implementations of FIGS. 1-3, the tasks may be easily modified to apply to other implementations of the present disclosure. The tasks may be iteratively performed. The method may begin at 350. This may occur, for example, at a startup of the engine 102.

At 352, the APC module 199 and/or the air deactivation module 306 resets an air mass value ACT 320 for activated cylinders to zero. The air mass value ACT 320 may be a last air mass value determined for an activated cylinder prior to a cylinder intake or non-intake event, which is sequentially prior to a current cylinder intake event.

At 354, the APC module 199 and/or the activation module 308 resets an accumulated air mass value $DEACT_{PREV}$ for deactivated cylinders to zero. The accumulated air mass value $DEACT_{PREV}$ may be a last air mass value determined for a deactivated cylinder prior to a cylinder non-intake event that occurred sequentially prior to a current cylinder intake or non-intake event. At 355, the cylinder control module 206 and/or the cylinder status module determines an identifier (ID) for a current cylinder for which air mass is to be estimated.

At 356, the ECM 114, the APC module 199 and/or the MAF module 300 samples and converts the signal $MAF_{VOLT}$ from the MAF sensor 186 to a frequency signal $MAF_{FREQ}$ 324. The signal $MAF_{VOLT}$ may be sampled uniformly prior to (i) each cylinder intake event and/or non-intake event, and/or (ii) each intake stroke of each activated and deactivated cylinder. The signal $MAF_{VOLT}$ may be sampled (or read) during a low-resolution (less than a predetermined resolution) intake loop.

At 357, the ECM 114, the APC module 199 and/or the cylinder event module 302 counts the number of pulses in the frequency signal $MAF_{FREQ}$ 324 over a predetermined measuring period and prior to a next cylinder intake event. The predetermined measuring period may refer to a uniform number of cranking degrees between cylinder intake and non-intake events (e.g., 90° for an eight cylinder engine).

At 358, the engine speed module 200 determines a speed of the engine and generates the engine speed signal $E_{spd}$ 208.

At 360, the cylinder event module 302 determines an APC value $APC_{EVENT}$ 326 for a current cylinder intake or non-intake event of the current cylinder having the ID determined at 355. The cylinder event module 302 may determine the APC value $APC_{EVENT}$ 326 based on the engine speed signal $E_{spd}$ 208, the crank position signal CRANK 210, and the frequency signal $MAF_{FREQ}$ 324. The APC value $APC_{EVENT}$ 326 may be determined using a look-up table, an algorithm, or other suitable technique. The APC value $APC_{EVENT}$ 326 indicates an amount of air received by the intake manifold 110 since a beginning of a last cylinder intake event of an activated cylinder or since a last cylinder non-intake event of a deactivated cylinder. This may be, for example, an amount of air received for a previous 90° of rotation of the crankshaft 119 for an eight cylinder engine.

At 362, the cylinder status module 304 determines an activated or deactivated status of a current cylinder for a current intake timing event or intake stroke. An intake timing event may refer to a cylinder intake event for an activated cylinder and a cylinder non-intake event for a deactivated cylinder. The activated or deactivated status in indicated via a status signal STAT 328.

At 364, the APC module 199 proceeds to task 366 when the status signal STAT indicates that the current cylinder is deactivated. The APC module 199 proceeds to task 370 when the status signal STAT indicates that the current cylinder is activated.

At 366, the deactivation accumulation module 306 determines an accumulated air mass $DEACT_{CUR}$ 330 received in the intake manifold 110 of the engine 102 during a current cylinder non-intake event and cylinder non-intake event(s) sequentially prior to the current cylinder non-intake event. The accumulated air mass $DEACT_{CUR}$ 330 is set equal to the previous accumulated air mass $DEACT_{PREV}$ plus the APC value $APC_{EVENT}$ 326. This accounts for the air received during cylinder events of deactivated cylinders. The accumulated air mass $DEACT_{CUR}$ 330 may be an accumulated amount of air mass since a last activated cylinder and be an amount of air mass drawn into a next activated cylinder.

At 368, the deactivation accumulation module 306 sets the previous accumulated air mass $DEACT_{PREV}$ equal to the accumulated air mass $DEACT_{CUR}$ 330. Task 356 may be performed subsequent to task 368.

At 370, the activation summation module 308 determines the air mass value ACT 320 a current activated cylinder. The activation summation module 308 determines the air mass value ACT 320 based on the cylinder status signal STAT 328, the APC value $APC_{EVENT}$ 326, and the accumulated air mass $DEACT_{CUR}$ 330. The air mass value ACT 320 may be set equal to the accumulated air mass $DEACT_{CUR}$ 330 plus the APC value $APC_{EVENT}$ 326. This accounts for the amount of air received (i) during cylinder events of deactivated cylinders that occurred sequentially prior to the current cylinder event, and (ii) after a last cylinder event of an activated cylinder. The air mass value ACT 320 is overwritten during each iteration of task 370.

At 372, the estimation module 310 may estimate the air mass $MASS_{CurCyl}$ 332 drawn into a current cylinder based on, for example, the MAP signal 214, the engine speed $E_{spd}$ 208, throttle position as indicated by the driver input signal 230, and/or the air mass value ACT 320. At 374, the prediction module 312 may predict the air mass $MASS_{SubCyl}$ 334 drawn into one or more subsequent cylinders based on, for example, the MAP signal 214, the engine speed $E_{spd}$ 208, throttle position as indicated by the driver input signal 230, the air mass value ACT 320 and/or the air mass $MASS_{CurCyl}$ 332. The predicted air mass of a cylinder may occur 180° or more ahead of when the cylinder is to have a cylinder intake or non-intake event.

At 376, the ECM 114 may determine one or more parameters based on the air mass values $MASS_{CurCyl}$ 332, $MASS_{SubCyl}$ 334. The air mass values $MASS_{CurCyl}$ 332, $MASS_{SubCyl}$ 334 may be used for open loop fuel control. The one or more parameters may include, for example, fuel injection parameters, such as fuel injection amounts, fuel injection timing, number of fuel injections per cylinder cycle, fuel injection flow rates, etc. The one or more parameters may also include torque values, which may be provided to modules 206, 240, 244, 246, and 250 to generate the activation/deactivation sequence SEQ (or activation/deactivation pattern) and the controls signals 242, 246, 248, 252 for the actuators 116, 120, 124, 126, 164. Task 354 may be performed subsequent to task 376.

The above-described signals, values, identifiers, masses, tables, and parameters may be stored in a memory 340 and accessed by any of the modules of the ECM 114 and/or the APC module 199. The above-described tasks are meant to be illustrative examples; the tasks may be performed sequentially, synchronously, simultaneously, continuously, during overlapping time periods or in a different order depending upon the application. Also, any of the tasks may not be performed or skipped depending on the implementation and/or sequence of events.

The above-described method tracks a current cylinder ID and activation/deactivation states of a current cylinder and a last cylinder. This allows an accumulated total of air mass determined during cylinder events of deactivated cylinders to be used as the air mass value for a current activated cylinder. The method provides accurate air mass values of the intake manifold 110 and air mass values of each of the cylinders between intake and non-intake events and during non-uniform and/or changing activation/deactivation sequences.

The above-described method may be used to estimate or predict an amount of air mass in each cylinder of the engine 102 while operating at steady-state, as determined by the APC module 199 and/or the ECM 114. The engine 102 is operating at steady-state when air flow into an intake manifold 110 of the engine 102 is constant and/or within a predetermined range of a predetermined amount of air flow. Change in air flow may be due to, for example, a change in the throttle position and/or changes in positions of the cam phasers 148, 150.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated; or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A system comprising:

a cylinder event module that determines an air-per-cylinder value for one of a cylinder intake event or a cylinder non-intake event of a current cylinder of an engine based on a mass air flow signal and an engine speed signal, wherein the engine includes a plurality of cylinders including the current cylinder;

a status module that generates a status signal indicating whether the current cylinder is activated or deactivated;

a deactivation module that, based on the status signal, determines a current accumulated air mass in an intake manifold of the engine for air received by the intake manifold since a last cylinder intake event of an activated cylinder and prior to one or more cylinder non-intake events of one or more deactivated cylinders, and based on a previous accumulated air mass in the intake manifold and the air-per-cylinder value;

an activation module that, based on the status signal, determines an air mass value for the current cylinder based on the air-per-cylinder value and the current accumulated air mass; and a fuel control module configured to control fuel injection for one or more of the plurality of cylinders based on the air mass value.

2. The system of claim 1, wherein the cylinder event module determines:

air-per-cylinder values for cylinder intake events of activated cylinders of the engine based on the mass air flow signal and the engine speed signal, wherein the mass air flow signal indicates an amount of air received by the intake manifold, and wherein each of the air-per-cylinder values for the cylinder intake events indicates an amount of air received by the intake manifold since a beginning of a last cylinder intake event of an activated cylinder, or a last cylinder non-intake event of a deactivated cylinder; and air-per-cylinder values for cylinder non-intake events of deactivated cylinders of the engine based on the mass air flow signal and the engine speed signal, wherein each of the air-per-cylinder values for the cylinder non-intake events indicates an amount of air received by the intake manifold since a beginning of a last cylinder intake event of an activated cylinder, or a last cylinder non-intake event of a deactivated cylinder.

3. The system of claim 1, a cylinder control module that randomly selects one or more of the plurality of cylinders, deactivates the selected one or more cylinders, and activates the other ones of the plurality of cylinders.

4. The system of claim 1, further comprising an engine speed module configured to determine an engine speed of the engine, wherein the cylinder event module determines the air-per-cylinder value based on the engine speed.

5. The system of claim 4, further comprising an air flow module that generates a frequency signal based on a voltage received from a mass air flow sensor, wherein the cylinder event module determines the air-per-cylinder value based on the frequency signal.

6. The system of claim 1, wherein:

the status signal indicates that the current cylinder is deactivated;

the deactivation module sets the current accumulated air mass equal to a sum of the previous accumulated air mass and the air-per-cylinder value; and the previous accumulated air mass was determined prior to a cylinder non-intake event of a cylinder having an intake stroke consecutively prior to an intake stroke of the current cylinder.

7. The system of claim 1, wherein:

the status signal indicates that the current cylinder is activated;

the activation module sets the air mass value equal to a sum of the air-per-cylinder value and the current accumulated air mass; and the current accumulated air mass was determined prior to a cylinder non-intake event of a cylinder having an intake stroke consecutively prior to an intake stroke of the current cylinder.

8. The system of claim 1, wherein the cylinder event module determines air-per-cylinder values for each cylinder intake event of activated cylinders and air-per-cylinder values for each cylinder non-intake event of deactivated cylinders.

9. The system of claim 1, wherein the deactivation module determines the current accumulated air mass for air received by the intake manifold since a last cylinder intake event of an activated cylinder and during a plurality of consecutive cylinder non-intake events of a plurality of deactivated cylinders.

10. The system of claim 9, wherein:

the cylinder event module determines an air-per-cylinder value for a second cylinder, wherein the second cylinder is subsequent to the current cylinder and is activated; and the activation module overwrites the current accumulated air mass to be equal to the second air-per-cylinder value and determines a second air mass value for the second cylinder based on the second air-per-cylinder value, not the previous accumulated air mass, and not the first air mass value.

11. A method comprising:

determining an air-per-cylinder value for one of a cylinder intake event or a cylinder non-intake event of a current cylinder of an engine based on a mass air flow signal and an engine speed signal, wherein the engine includes a plurality of cylinders including the current cylinder;

generating a status signal indicating whether the current cylinder is activated or deactivated;

based on the status signal, determining a current accumulated air mass in an intake manifold of the engine for air received by the intake manifold since a last cylinder intake event of an activated cylinder and prior to consecutive cylinder non-intake events of at least two deactivated cylinders, and based on a previous accumulated air mass in the intake manifold and the air-per-cylinder value;

based on the status signal, determining an air mass value for the current cylinder based on the air-per-cylinder value and the current accumulated air mass; and controlling fuel injection for one or more of the plurality of cylinders based on the air mass value.

12. The method of claim 11, further comprising:

determining air-per-cylinder values for cylinder intake events of activated cylinders of the engine based on the mass air flow signal and the engine speed signal, wherein the mass air flow signal indicates an amount of air received by the intake manifold, and wherein each of the air-per-cylinder values for the cylinder intake events indicates an amount of air received by the intake manifold since a beginning of a last cylinder intake event of an activated cylinder, or a last cylinder non-intake event of a deactivated cylinder; and determining air-per-cylinder values for cylinder non-intake events of deactivated cylinders of the engine based on the mass air flow signal and the engine speed signal, wherein each of the air-per-cylinder values for the cylinder non-intake events indicates an amount of air received by the intake manifold since a beginning of a last cylinder intake event of an activated cylinder, or a last cylinder non-intake event of a deactivated cylinder.

13. The method of claim 11, further comprising:

randomly selecting one or more of the plurality of cylinders;

deactivating the selected one or more cylinders; and activating the other ones of the plurality of cylinders.

14. The method of claim 11, further comprising determining an engine speed of the engine, wherein the air-per-cylinder value is determined based on the engine speed.

15. The method of claim 4, further comprising generating a frequency signal based on a voltage received from a mass air flow sensor, wherein the air-per-cylinder value is determined based on the frequency signal.

16. The method of claim 11, further comprising setting the current accumulated air mass equal to a sum of the previous accumulated air mass and the air-per-cylinder value, wherein:

the status signal indicates that the current cylinder is deactivated; and the previous accumulated air mass was determined prior to a cylinder non-intake event of a cylinder having an intake stroke consecutively prior to an intake stroke of the current cylinder.

17. The method of claim 11, further comprising setting the air mass value equal to a sum of the air-per-cylinder value and the current accumulated air mass, wherein:

the status signal indicates that the current cylinder is activated; and the current accumulated air mass was determined prior to a cylinder non-intake event of a cylinder having an intake stroke consecutively prior to an intake stroke of the current cylinder.

18. The method of claim 11, further comprising determining air-per-cylinder values for each cylinder intake event of activated cylinders and air-per-cylinder values for each cylinder non-intake event of deactivated cylinders.

19. The method of claim 11, further comprising determining the current accumulated air mass for air received by the intake manifold since a last cylinder intake event of an activated cylinder and during a plurality of consecutive cylinder non-intake events of a plurality of deactivated cylinders.

20. The method of claim 9, further comprising:

determining an air-per-cylinder value for a second cylinder, wherein the second cylinder is subsequent to the current cylinder and is activated; and overwriting the current accumulated air mass to be equal to the second air-per-cylinder value and determines a second air mass value for the second cylinder based on the second air-per-cylinder value, not the previous accumulated air mass, and not the first air mass value.

* * * * *